US009744569B2

(12) United States Patent
Suematsu et al.

(10) Patent No.: US 9,744,569 B2
(45) Date of Patent: Aug. 29, 2017

(54) METHOD FOR CLEANING PIPING AND CLEANING SYSTEM FOR PIPING

(71) Applicant: HITACHI, LTD., Tokyo (JP)

(72) Inventors: Takaaki Suematsu, Tokyo (JP); Tokuo Kure, Tokyo (JP); Kenji Saito, Tokyo (JP); Eiji Higashi, Tokyo (JP); Tomoyuki Araki, Tokyo (JP)

(73) Assignee: HITACHI, LTD., Tokyo (JP)

( * ) Notice: Subject to any disclaimer, the term of this patent is extended or adjusted under 35 U.S.C. 154(b) by 133 days.

(21) Appl. No.: 14/439,496

(22) PCT Filed: Oct. 18, 2013

(86) PCT No.: PCT/JP2013/078346
§ 371 (c)(1),
(2) Date: Apr. 29, 2015

(87) PCT Pub. No.: WO2014/069259
PCT Pub. Date: May 8, 2014

(65) Prior Publication Data

US 2015/0298179 A1 Oct. 22, 2015

(30) Foreign Application Priority Data

Oct. 29, 2012 (JP) ..... 2012-237991

(51) Int. Cl.
*B08B 3/00* (2006.01)
*B08B 9/032* (2006.01)
(Continued)

(52) U.S. Cl.
CPC ..... *B08B 9/032* (2013.01); *B08B 9/027* (2013.01); *F28G 9/00* (2013.01); *B08B 2203/005* (2013.01)

(58) Field of Classification Search
CPC ... B08B 9/032; B08B 9/027; B08B 2203/005; F28G 9/00
(Continued)

(56) References Cited

U.S. PATENT DOCUMENTS 6,875,323 B2 4/2005 Yaita et al.
7,087,120 B1 * 8/2006 Enda ..... G21F 9/28 134/26

FOREIGN PATENT DOCUMENTS

FR EP 0628969 A1 * 12/1994 ..... F22B 37/483
JP 2003220373 A 8/2003
(Continued)

OTHER PUBLICATIONS

EPO machine translation of EP0622869, retrieved Oct. 30, 2016.*
Jan. 14, 2014 International Search Report issued in International Application No. PCT/JP2013/078346.

*Primary Examiner* — Eric Golightly
(74) *Attorney, Agent, or Firm* — Oliff PLC

(57) ABSTRACT

A method for cleaning piping including the steps of supplying an acid to a cleaning water to prepare a cleaning water having pH of 4 or lower, mixing ozone gas to the cleaning water, and passing the cleaning water through the piping to be cleaned, or a cleaning system for piping, the system including a reservoir which retains cleaning water, an acid providing means supplies an acid to the cleaning water, an ozone generation means which generates ozone gas, a circulation flow path including a circulation pump which connects the reservoir and the ozone generation means in the form of a closed circuit, and circulates the cleaning water between the reservoir and ozone generation means, a conduction flow path including a conveying pump which communicates the reservoir and the piping to be cleaned, and conveys the cleaning water retained in the reservoir through the piping to be cleaned.

2 Claims, 5 Drawing Sheets

(51) Int. Cl.
*B08B 9/027* (2006.01)
*F28G 9/00* (2006.01)

(58) Field of Classification Search
USPC ..... 134/100.1
See application file for complete search history.

(56) References Cited

FOREIGN PATENT DOCUMENTS

| | | | |
|---|---|---|---|
| JP | 2004122020 | A | 4/2004 |
| JP | 2008221144 | A | 9/2008 |
| JP | 2011161418 | A | 8/2011 |

* cited by examiner

METHOD FOR CLEANING PIPING AND CLEANING SYSTEM FOR PIPING

BACKGROUND OF THE INVENTION

The present invention relates to a method for cleaning piping and a cleaning system for piping.

Cleaning out of place (COP) and cleaning in place (CIP) are used as methods for cleaning facility and apparatuses in the manufacturing industry and other industries.

Cleaning out of place is a method of cleaning each part and component after disassembling equipment.

In contrast, cleaning in place is a method of performing cleaning without disassembling equipment, which is implemented by integrating cleaning functions into the equipment, or in food manufacturing facility and apparatuses composed mainly of pipings and containers found in the food manufacturing industry, food processing industry and like industries, cleaning is carried out by passing through the piping a cleaning solution at a high pressure from the outside.

In cleaning in place carried out in such food manufacturing industry and food processing industry methods using alkali cleaning whose target of cleaning is mainly organic matters, and acid cleaning whose target of cleaning is mainly inorganic matters, are widely employed in combination. In addition to the cleaning processes by alkali detergents and acid detergents, chlorine-based or iodine-based disinfectants are used for the purpose of disinfection of equipment, and surfactants are used for the purpose of deodorizing, including many other agents. These cleaning solutions, water used before and after cleaning processes for rinsing, and sterilizing steam has a temperature adjusted to increase cleaning efficiency. Normally, such liquids are heated to a high temperature for use, and are then cooled to be drained. Accordingly, considerable amount of time, agents, and energies are required for cleaning processes.

Conventionally, as a technique which is capable of performing cleaning with a high degree of cleaning, shortening the time for cleaning in place, and reducing the amounts of agents and other substances used during cleaning in place, there has been a cleaning method for on-site cleaning of equipment such as filling equipment that fills beverages, etc. into bottles, cans, and other containers, liquid treatment equipment for filling solutions, and pipe equipment for connecting the equipment, in which liquid comprising nanobubbles is conveyed into the equipment and is left undisturbed to soak for a prescribed period, and the gas of nanobubbles used being ozone gas so that a bactericidal action and a deodorizing action are added (refer to Japanese Unexamined Patent Publication No. 2012-45528).

Moreover, as a cleaning technique using ozone water, there has been a cleaning method for electronic materials such as silicon substrates for semiconductors and glass substrates for liquid crystals, the method comprising the steps of cleaning with ozone water containing an acid and cleaning with ozone water containing an alkali (refer to Japanese Unexamined Patent Publication No. 2002-001243).

BRIEF SUMMARY OF THE INVENTION

However, the related art techniques have been having the problem that, at the ends of pipings to be cleaned included in the equipment, the concentration of ozone used for cleaning is lowered so that sufficient cleaning cannot be carried out.

Moreover, a multi-step cleaning in place method including a cleaning process, disinfection, and a deodorizing process in combination has the problems of prolonged cleaning time, use of large amount of cleaning solutions and agents, a high load on wastewater, and a great amount of energy consumption accompanying the adjustment of the temperature of the cleaning water.

In particular, in the manufacturing of liquid foods, disinfection with heating is an essential step, but the heat exchanger used in the disinfection step is prone to contaminant deposition, and it is known that an increase in the heating temperature increases the amounts of inorganic matters contained deposited on the surface of the heat exchanger. Fixed and strong contaminants which are inorganic matters such as calcium and magnesium bound to such organic matters are difficult to remove, and considerable time is required for the cleaning process in many cases.

Accordingly, a cleaning method having higher cleaning ability and efficiency is desired.

To this end, an object of the present invention is to provide a means for efficiently cleaning the piping included in the equipment with a high cleaning capability.

A first aspect of the invention which has addressed the object is a method for cleaning piping in which an inside of the piping to be cleaned is cleaned by conveying the cleaning water through the piping, the method including the steps of:

preparing a cleaning water having pH of 4 or lower by supplying an acid to the cleaning water, mixing ozone gas in the cleaning water, and conveying the cleaning water through the piping to be cleaned.

A second aspect of the invention is is a cleaning system for piping which cleans inside the piping by conveying a cleaning water through a piping to be cleaned, the cleaning system including:

a reservoir for retaining the cleaning water, an acid providing means which supplies an acid to the cleaning water, an ozone generation means which generates ozone gas, a circulation flow path including a circulation pump which connects the reservoir and the ozone generation means in the form of a closed circuit, and circulates the cleaning water between the reservoir and ozone generation means, and a conduction flow path including a conveying pump which communicates the reservoir and the piping to be cleaned, and conveys the cleaning water retained in the reservoir through the piping to be cleaned, the cleaning system circulating the cleaning water containing the acid through the circulation flow path mixing the ozone gas into the cleaning water, and conveying the cleaning water through the piping to be cleaned via conduction flow path.

According to the aspects of the present invention, the piping included in the equipment can be cleaned with a high cleaning capability and efficiently.

For example, high cleaning capability is also obtained by ozone at a high concentration at the end of the piping included in the equipment, which improves the cleaning efficiency of the piping.

Moreover, composite contaminants generated by binding of organic matters and such as inorganic matters calcium magnesium can be property cleaned and can be removed.

Moreover, the cleaning time required for achieving a predetermined cleaning process is shortened, the consumption of the energies required for the cleaning process is suppressed, and the load of the wastewater involved in the cleaning process can be reduced.

DETAILED DESCRIPTION OF THE INVENTION

Figure 1:
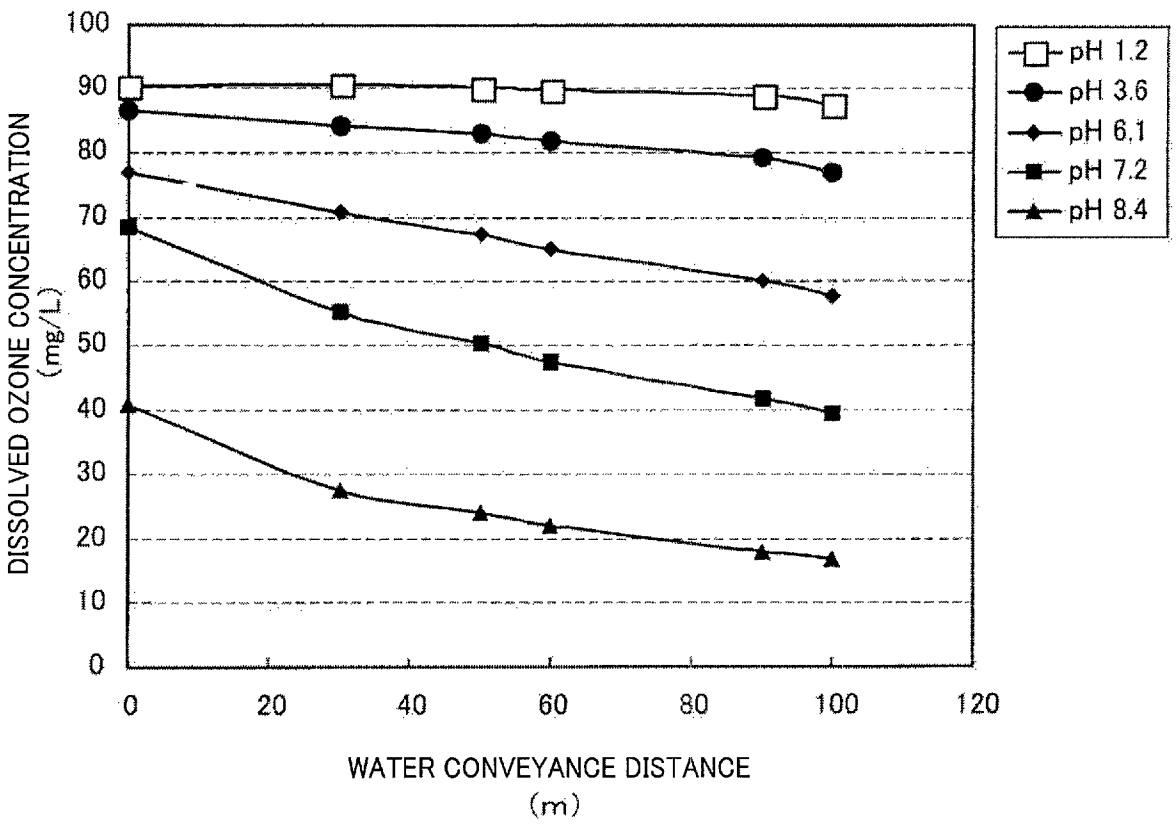
FIG. 1 is a diagram which shows the relationship between a water conveyance distance (m) and a dissolved ozone concentration (mg/L) when a cleaning water in which ozone is dissolved is conveyed through a piping to be cleaned.

A method for cleaning piping which is an embodiment of the present invention is a method for cleaning inside a piping by conveying the cleaning water through the piping to be cleaned, the method including the steps of:

supplying an acid to a cleaning water to prepare a cleaning water having pH of 4 or lower (acid supplying step), mixing ozone gas to the cleaning water (ozone mixing step), and passing the cleaning water through the piping to be cleaned (water conduction step).

In this embodiment, cleaning of the inner face of the piping is performed by passing an acidic the cleaning water in which ozone is dissolved through a hollow pipe provided in the facility and apparatuses for the purpose of transporting a fluid.

Pipings suitable for this cleaning include those provided in food manufacturing facilities and food manufacturing apparatuses. In particular, it is suitable for pipings having contamination by organic matters such as proteins and lipids and inorganic matters such as calcium and magnesium.

The method for cleaning piping of this embodiment can be any method which includes at least the above mentioned steps, but preferably a method which includes the above-mentioned steps in the order stated. By mixing ozone after setting the pH of the cleaning water to 4 or lower, a cleaning water in which ozone is dissolved at a high concentration can be prepared.

In this embodiment, the cleaning water denotes a liquid mainly composed of water for cleaning the piping, including the acidic cleaning water in which ozone is dissolved passed through the piping to be cleaned, raw water used as a raw material of the same, raw water with an acid added thereto for pH adjustment, and the like.

As the raw water, water which has undergone various treatments such as distilled water, purified water, sterilization water, and water having additives such as surfactants mixed therein can be used, but normally, tap water is used.

The temperature of the raw water is not particularly limited, but is preferably in an ordinary temperature range, for example, around 20±15° C.

(Acid Providing Step)

In the acid supplying step, an acid is supplied to the cleaning water to prepare a cleaning water having pH of 4 or lower.

The acid is supplied, for example, by retaining the cleaning water in an amount required for water conduction through the piping in a container, and then adding the acid to the cleaning water with stirring of the cleaning water. The container used for retaining the cleaning water that made of materials having resistance to the acid and resistance to corrosion by ozone.

Supplying the acid may be carried out by measuring the pH of the cleaning water with a pH meter until a predetermined value is reached, or by adding a predetermined amount of acid to a predetermined amount of the cleaning water.

The acid provided may be any of inorganic acids such as nitric acid, nitrous acid, halogen acid, perhalogen acid, halogenous acid, hypohalogenous acid, sulfuric acid, sulfurous acid, phosphoric acid, phosphorous acid, carbonic acid, permanganic acid and boric acid, and organic acids such as carboxylic acid and sulfonic acid, but an acid having high solubility into the cleaning water near an ordinary temperature, an acid which does not react with ozone, and an acid having high cleaning capability for inorganic matters are preferable, and nitric acid is suitably used.

The pH of the cleaning water prepared is not particularly limited as long as it is pH 4 or lower, but it preferably in the acidic region, and is preferably pH 2 or lower.

(Ozone Mixing Step)

In the acid supplying step, ozone gas is mixed into the cleaning water.

Mixing the ozone gas is carried out, for example, by flowing ozone gas through the cleaning water sealed in an airtight container or bringing the cleaning water into contact with ozone gas sealed in an airtight container. Such methods include a method and injecting the ozone gas into the cleaning water of sealing the cleaning water in an airtight container, a method of sucking and mixing the ozone gas with an ejector, a method of bringing ozone gas into contact with the cleaning water via an ozone permeable membrane, among other methods.

The ozone gas is produced by a method of generating silent discharge and corona discharge in oxygen gas, a method of irradiating oxygen gas with an ultraviolet ray, among other methods. Oxygen gas used may be any of oxygen gas generated by electrolysis, oxygen gas concentrated from air or the like, but is preferably that which has been refined by nitrogen removal or other treatment.

The concentration of the ozone gas mixed is not particularly limited, but is preferably mixed to a saturated concentration, and ozone is preferably mixed in the cleaning water at an ordinary temperature so that the ozone concentration is 50 mg/L or higher.

(Water Conduction Step)

In the acid supplying step, the cleaning water is passed through the piping to be cleaned.

Water conduction of the cleaning water is carried out, for example, using a pump which is capable of conveying the cleaning water to a downstream end which is a position where the piping structure of the piping to be cleaned ends.

Water conduction is preferably performed by connecting the container in which the cleaning water with ozone mixed thereinto is prepared and the piping to be cleaned by piping or other means to maintain a sealed state.

The temperature of the conducted cleaning water is preferably in the range from 25° C. to 60° C.

The flow velocity and the flow rate of the cleaning water conducted can be the values which are suitably adjusted depending on the capacity, form, and degree of contamination of the piping to be cleaned dirt, among other conditions.

FIG. 1 is a diagram which shows the relationship between a water conveyance distance (m) and a dissolved ozone concentration (mg/L) when the cleaning water with ozone mixed thereinto is conveyed through the piping to be cleaned.

FIG. 1 show the results of measurement of dissolved ozone in the cleaning waters, which were prepared by supplying acid to tap water, and mixing ozone gas until saturated to have pH of 1.2 (□), pH of 3.6 (●), pH of 6.1 (♦), pH of 7.2 (■), and pH of 8.4 (▲), respectively, after being conveyed through the piping for distances of 0 m, 20 m, 60 m, 80 m and 100 m. As shown in FIG. 1, the lower the pH of the cleaning water, the higher the initial concentration of ozone dissolved in the cleaning water. Moreover, the lower the pH of the cleaning water, the more the decrease in the ozone concentration after the water conveyance is suppressed.

Figure 2:
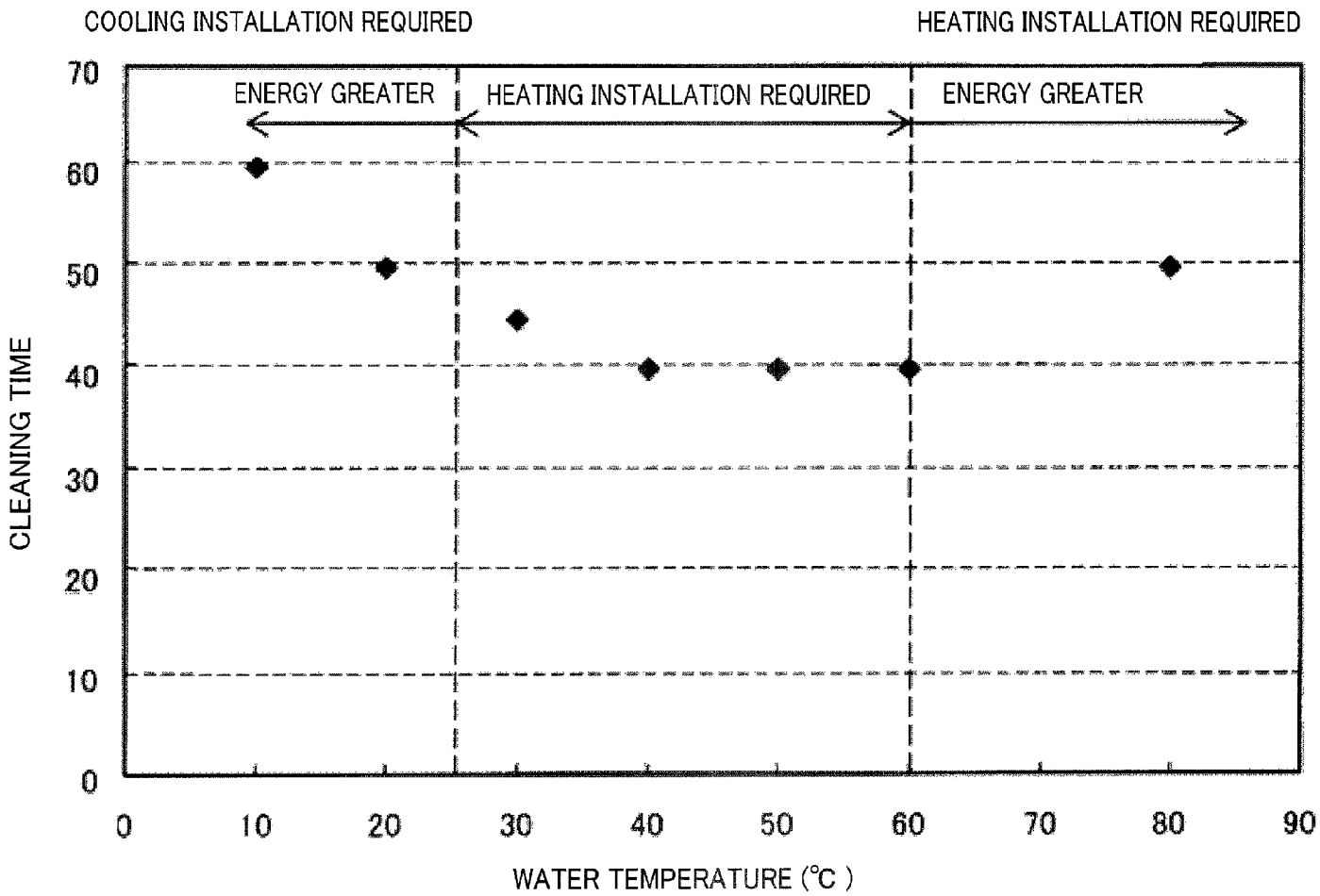
FIG. 2 is a diagram which shows the relationship between a water temperature (° C.) and a cleaning time when a cleaning water in which ozone is dissolved is conveyed through a piping to be cleaned.

FIG. 2 is a diagram which shows the relationship between a water temperature (° C.) and a cleaning time when the cleaning water is passed through the piping to be cleaned, showing the results of the measurement of the water conduction time required to clean the piping to be cleaned to a predetermined degree by passing each of the cleaning waters having a temperature adjusted from an ordinary temperature (25° C.) to a temperature ranging from 10° C. to 80° C. As shown in FIG. 2, when the temperature of the cleaning water is in the range from 25° C. to 60° C., the time required for cleaning is shortened.

As described above, according to the method for cleaning piping of this embodiment, the concentration of ozone dissolved in the cleaning water can be high by setting the pH of the cleaning water to 4 or lower.

Moreover, the energy consumption for setting the concentration of dissolved ozone high is reduced. Generally, in order to increase the concentration of ozone in a nearly neutral cleaning water, the cleaning water needs to be cooled, and in order to increase the concentration of ozone of the cleaning water nearly weakly acidic, a high-pressure ozone gas is required.

When the cleaning water has pH of 4 or lower, a cleaning water having a concentration of ozone as high as 50 mg/L or higher can be easily prepared, and about 90% of ozone remains even in the cleaning water which has been conveyed for 100 m inside the piping, which improves the cleaning efficiency of the piping.

Moreover, by the action of the cleaning water as an acid, the cleaning capability for contaminants having high amounts of inorganic matters contained is improved, and by setting the temperature of the cleaning water conducted to fall within the range from 25° C. to 60° C., the cleaning time is shortened, and cleaning efficiency is improved. The cleaning water which is used at a temperature ranging from 25° C. to 60° C. does not require excessive energy for adjusting the temperature, and can be prepared by using tap water in an ordinary temperature range.

Subsequently, a cleaning system for piping according to an embodiment of the present invention will be specifically described with reference to drawings as necessary.

Figure 3:
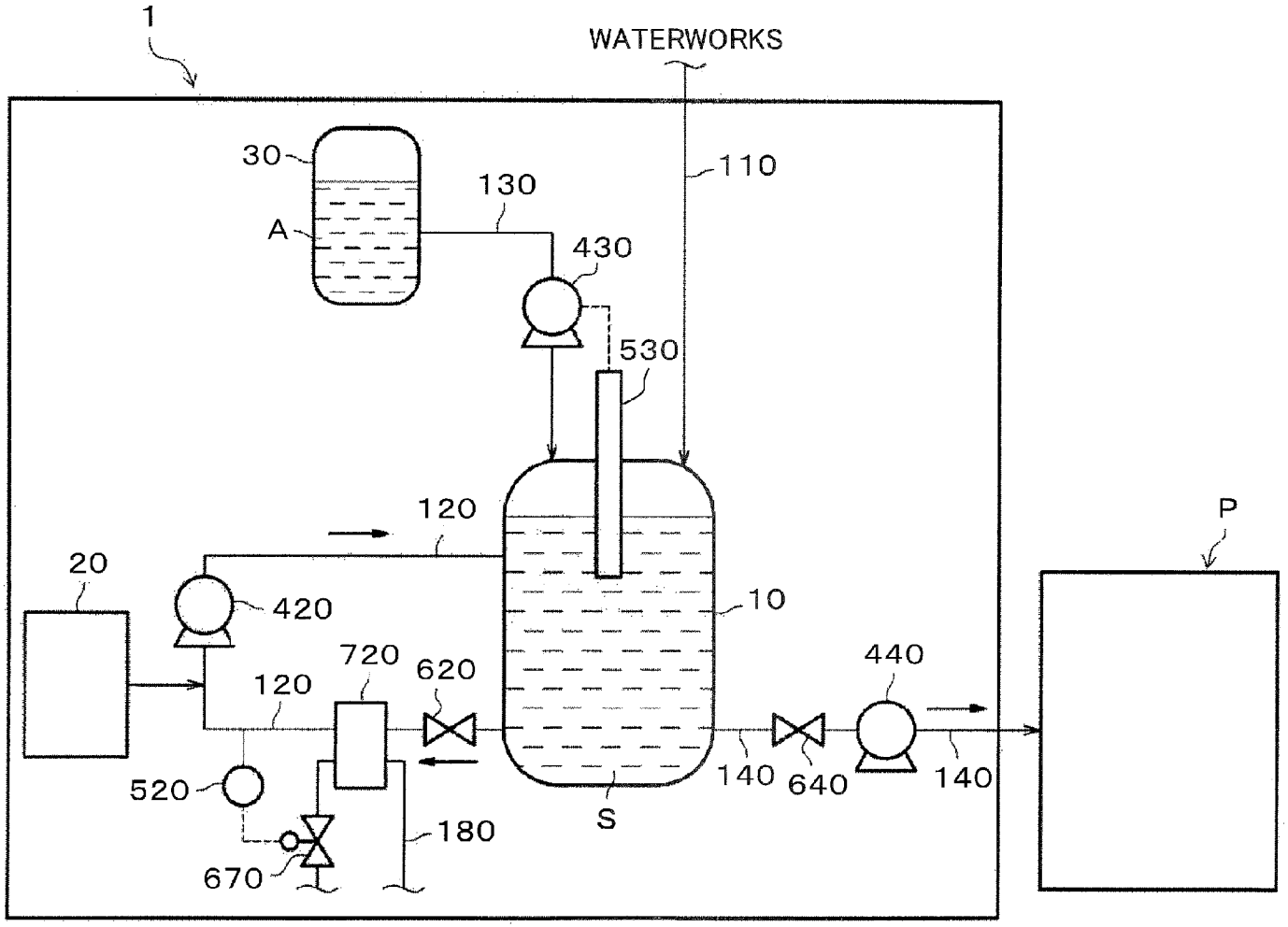
FIG. 3 is a block diagram of a cleaning system for piping according to an embodiment.

FIG. 3 is a block diagram of a cleaning system 1 for piping according to an embodiment. This cleaning system is an apparatus which performs cleaning in place of equipment including piping as a component, which connects a piping to be cleaned P of the equipment to be cleaned, and then cleans the inside of the piping by passing the cleaning water inside the piping to be cleaned. In this cleaning system, ozone water which is prepared by turning raw water into acidic and then dissolving ozone therein is used as the cleaning water.

With reference to FIG. 3, the constitution of the cleaning system for piping 1 will be described.

The cleaning system for piping 1 is mainly constituted by a reservoir 10, an acid providing means 30, an ozone generation means 20, a circulation pump 420, and a conveying pump 440.

The reservoir 10 is an airtight container which retains a cleaning water S passed through the piping to be cleaned P. Moreover, the reservoir 10 is used to temporarily retain raw water for preparing the cleaning water S.

The material of the reservoir 10 is a metal having resistance to the acid and ozone, with which the container is brought into contact, for example, stainless steel. More specifically, it is SUS304, SUS316, and the like.

A pH measuring means 530 which measures the pH of the retained cleaning water or raw water is provided within the reservoir 10.

The reservoir 10 may be provided with other means (not shown) for measuring the circumstance inside the reservoir, for example, a temperature measuring means, a water level measuring means, and a pressure measuring means, and a stirring means.

To the reservoir 10 are connected a water supply path 110 which serves as a flow path of raw water, an acid supply path 130 which serves as a flow path of acid A, a circulation flow path 120 which serves as a flow path of the cleaning water S, and a conduction flow path 140 in a manner of communicating with the inside of the reservoir 10, forming a series of flow paths in the cleaning system.

Other flow paths, for example, a wastewater flow path which discharges the cleaning water S to the outside of the cleaning system, which is not shown, may be connected to these flow paths.

The flow path is formed by a closed structure within the piping or cleaning system.

The water supply path 110 connects the waterworks and the reservoir 10, and forms a flow path which draws tap water used as raw water from the waterworks into the reservoir 10.

A valve (not shown) is provided on the water supply path 110, which operates opening and closing of the flow path.

Moreover, other means (not shown), for example, a raw water transport means, a temperature measuring means, a flow rate measuring means, a filter or the like may be provided on the water supply path 110.

The water supply path 110, as shown in FIG. 3, is connected to the waterworks, and may be connected to a tank retaining raw water or the like.

The circulation flow path 120 includes a supply flow path connected to the ozone generation means 20 from the reservoir 10, and a return flow path connected from the ozone generation means 20 to the reservoir 10 again, and forms a flow path which connects the reservoir 10 and the ozone generation means 20 in the form of a closed circle.

A valve 620 is provided on the upstream side of the supply flow path on the circulation flow path 120. A flow control valve such as a proportional control valve may be used as the valve 620, so that the flow rate of the cleaning water S retained in the reservoir 10 circulating in the circulation flow path 120 can be controlled.

Moreover, the circulation flow path 120 is provided with the circulation pump 420 on the return flow path.

The circulation flow path 120, as shown in FIG. 3, is provided with a temperature measuring means 520 and a temperature control means 720 on the supply flow path, and may be provided with other means (not shown), for example, a temperature measuring means and a flow rate measuring means.

Materials of piping and other components which form the circulation flow path 120 are metal having resistance to the acid and ozone, with which the container is brought into contact, for example, stainless steel. More specifically, it is SUS304, SUS316, and the like.

The circulating pump 420 transports the cleaning water S retained in the reservoir 10 to the ozone generation means 20 through the supply flow path, transports the cleaning water S from the ozone generation means 20 to the reservoir 10 through a return flow path, and circulates the retained cleaning water S. The system is so constructed that the cleaning solution S is agitated by operation of the circulating pump 420 while it circulates through the circulation flow passage 120, and retained in the reservoir 10 in the uniform state.

The circulating pump 420 may be either of immersion type or pressure-up type, but is preferably that which has small mechanical movement and is capable of suppressing ozone decomposition.

The ozone generation means 20 is a means for generating ozone gas to be mixed into the cleaning water.

The ozone generation means 20 can be constituted, for example, by combining an ozone generator which generates ozone by silent discharge, corona discharge, ultraviolet irradiation, etc., and an oxygen generating apparatus or an oxygen cylinder which adsorbs and removes nitrogen in dehumidified air, and condenses oxygen gas.

The ozone generation means 20 is so constituted that it has a gas outlet connected to the circulation flow path 120, and the generated ozone gas is flown through or brought into contact with the cleaning water S circulating through the circulation flow path 120.

The acid supply path 130 connects the reservoir 10 to the acid supply means 30, and forms a flow path which supplies a solution-like acid A to the reservoir 10.

The acid supply path 130 is provided with a valve (not shown), which operates opening and closing of the flow path.

Moreover, as shown in FIG. 3, the acid supply path 130 may be provided with an acid supply pump 430, and may be provided with other means (not illustrated), for example, a temperature measuring means, a flow rate measuring means, a filter, etc.

Materials of piping and other components which form the acid supply path 130 are synthetic resins or metals having resistance to the acid, with which the piping is brought into contact. The piping may be that which has an acid-resistant lining or the like.

The acid supply means 30 is a means for supplying acid to the raw water or cleaning water used in the cleaning system.

The acid supply means 30 can be constituted, for example, by combining an acid storage container which retains a solution-like acid, and an acid transfer means which conveys the solution-like acid. In this embodiment, as shown in FIG. 3, the acid supply pump 430 is provided as an acid transfer means.

Materials of the acid storage container are synthetic resins or metals having resistance to the acid, with which the container is brought into contact. The container may be that which has an acid-resistant lining or the like.

The acid supply pump 430 supplies the acid A retained in the acid supply means 30 to the reservoir 10 through the acid supply path 130, and pours the acid A into the retained cleaning water.

The acid supply pump 430 may be either of immersion type or pressure-up type.

Moreover, the acid supply pump 430 may be so constituted that, as shown by the dashed line in FIG. 3, it is connected to the pH measuring means 530 provided on the reservoir 10 via a control line to be operated and controlled based on pH of the cleaning water S. For example, the acid supply pump 430 is controlled to, when the measurement value of the pH measuring means 530 exceeds a predetermined pH, operate to supply the acid A to the reservoir 10, and when the value is equal to or higher than the predetermined pH, to stop operating to pause the supply of the acid A to the reservoir 10.

When the cleaning system 1 is connected to the piping to be cleaned P, a conduction flow path 140 connects the piping to be cleaned P to the reservoir 10, and forms a flow path which supplies the cleaning water S retained in the reservoir 10 to the piping to be cleaned P.

A valve 640 is provided on the conduction flow path 140, which operates opening and closing of the flow path. A flow control valve such as a proportional control valve or a stop valve such as a check valve is used as the valve 640.

Moreover, the conduction flow path 140 is provided with the conveying pump 440.

The conduction flow path 140 may be provided with other means (not illustrated), for example, a temperature measuring means, a flow rate measuring means, a filter or the like.

Materials of piping and other components which form the conduction flow path 140 are metals having resistance to the acid and ozone, with which the piping is brought into contact, for example, stainless steel. More specifically, it is SUS304, SUS316, and the like.

A conveying pump 440 conveys the cleaning water retained in the reservoir 10 to the piping to be cleaned P, and flows the cleaning water in the pipe of the piping to be cleaned P.

The conveying pump 440 may be either of immersion type or pressure-up type, but is preferably that which has small mechanical movement and is thus capable of suppressing ozone decomposition caused by the movement.

The cleaning system 1 can be provided with the temperature control means 720 which controls the temperature of the cleaning water S on the flow path or the reservoir.

The temperature control means 720 controls the temperature of the cleaning water S to a temperature suitable for cleaning, for example, a preset temperature ranging from 25° C. to 60° C.

In FIG. 3, the supply flow path of the circulation flow path 120 is provided with the heat exchanger 720, which is the temperature control means 720, and the temperature measuring means 520. As shown by the broken line in FIG. 3, the cleaning system 1 is constituted by connecting the valve 670 provided on a heat exchange medium flow path 180, and the temperature measuring means 520 via a control line so that the temperature of the cleaning water S is controlled.

The temperature control means 720 may be constituted by a heating means, such as a heater, as long as the temperature of the cleaning water S can be controlled to a temperature suitable for cleaning, for example, a predetermined value ranging from 25° C. to 60° C.

The temperature measuring means 520 may be a contact type or non-contact type thermometer.

Subsequently, the operation of the cleaning system for piping 1 will be described.

The cleaning system 1 is connected to the piping to be cleaned P of the equipment to form the conduction flow path 140 which supplies he cleaning water S retained in the reservoir 10 in advance to the piping to be cleaned P. For example, the piping and other components which form the conductance flow path 140 are connected to an opening of the piping to be cleaned P via a joint.

Moreover, it is connected to the waterworks to form the water supply path 110 which draws tap water used as raw water from the waterworks into the reservoir 10.

In addition, the solution-like acid A is retained in the acid supply means 30.

First, raw water which serves as the cleaning water S is retained in the reservoir 10 of the cleaning system 1.

By opening the water supply path 110 which connects the waterworks to the reservoir 10, tap water used as raw water is poured from the waterworks into the reservoir 10.

The amount of poured raw water is managed so that a predetermined amount of the raw water is retained in the reservoir 10 based on the water level and other conditions, and when the amount of the raw water retained reaches a predetermined amount, the water supply path 110 is closed.

While water is being poured into the reservoir 10, the valves 620, 640 are fully closed.

Next, an acid is supplied to the cleaning water (raw water) retained in the reservoir 10, and the acidic cleaning water S is prepared.

The acid supply path 130 which connects the acid supply means 30 to the reservoir 10 is opened, and the acid supply pump 430 is driven. Accordingly, the acid A retained in the acid supply means 30 is supplied from the acid supply means 30 into the reservoir 10.

Subsequently, the fully closed state of the valve 620 provided on the circulation flow path 120 is cancelled, the circulation flow path 120 is opened, and the circulating pump 420 is driven.

The cleaning water (raw water) retained in the reservoir 10 circulates through the circulation flow path 120 with the acid A supplied from the acid supply means 30 according to the operation of the circulating pump 420, and the acid A is uniformly mixed with the cleaning water S. The pH of the cleaning water S to which the acid A is supplied is managed by the pH measuring means 530 so that pH has a predetermined value.

When the pH of the cleaning water S to which the acid A is supplied reaches equilibrium at a predetermined value, operation of the acid supply pump 430 is stopped and the supply of the acid A to the reservoir 10 is terminated. The acid supply pump 430 may be operated to stop running, based on the measurement signal outputted from the pH measuring means 530 provided on the reservoir 10.

While the acidic cleaning water S is being prepared, the valve 640 is fully closed.

Next, ozone gas is mixed into the prepared acidic cleaning water S, whereby the cleaning water S in which ozone dissolved is prepared.

In order for the cleaning water S to continue to circulate through the circulation flow path 120, the operation of the circulation pump 420 is successively continued, and the ozone generation means 20 is newly driven.

By the supply of the oxygen gas to the started ozone generator, the ozone generation means 20 induces dissociation and rebinding of oxygen molecules, generates ozone gas, and starts flowing ozone gas to the circulation flow path 120.

As the operation of the circulating pump 420 is continued, the cleaning water S which circulates through the circulation flow path 120, and the ozone gas generated by the ozone generation means 20 are mixed, and the cleaning water Sin which ozone is dissolved is prepared.

When the operation of the circulating pump 420 and the ozone generation means 20 is continued, the concentration of ozone in the cleaning water S in the reservoir 10 and the circulation flow path 120 increases gradually, and the cleaning water S having a high concentration of ozone dissolved therein is retained in the reservoir 10.

Next, the prepared cleaning water S in which ozone is dissolved is passed through the piping to be cleaned P. The fully closed state of the valve 640 provided on the conduction flow path 140 which connects the reservoir 10 to the piping to be cleaned P is cancelled, the conduction flow path 140 is opened, and the conveying pump 440 is driven. The cleaning water S in which ozone is dissolved and retained in the reservoir 10 is conveyed from the cleaning system 1 to the piping to be cleaned P via conduction flow path 140 as the conveying pump 440 is operated.

The cleaning water S which is conveyed to the piping to be cleaned P is passed through the piping to be cleaned from the upper stream end which is the connection position with the cleaning system 1 in the piping to be cleaned P to the downstream end which is a position where the piping structure ends of the piping to be cleaned P to clean the piping to be cleaned, and is then flown out to the outside of the piping as wastewater at the downstream end of the piping to be cleaned P.

The operation of the ozone generation means 20, the circulating pump 420, and the conveying pump 440 are then stopped as necessary, and cleaning of the piping is completed. The wastewater of the cleaning water S which flows to the outside of the piping to be cleaned P is undergoes a treatment for residual ozone, and is then sent to a general waste water treatment facilities or the sewer and wasted.

Since this cleaning system has such a structure that the acid supply means 30 is connected to the reservoir 10 via acid supply path 130, and the cleaning water S retained in the reservoir 10 circulates through the circulation flow path 120 to be mixed with ozone gas, the cleaning water S having a high concentration of ozone dissolved therein can be easily prepared by mixing ozone after setting the pH of the cleaning water S to 4 or lower.

Subsequently, a first variant of the embodiment of the present invention will be described.

Figure 4:
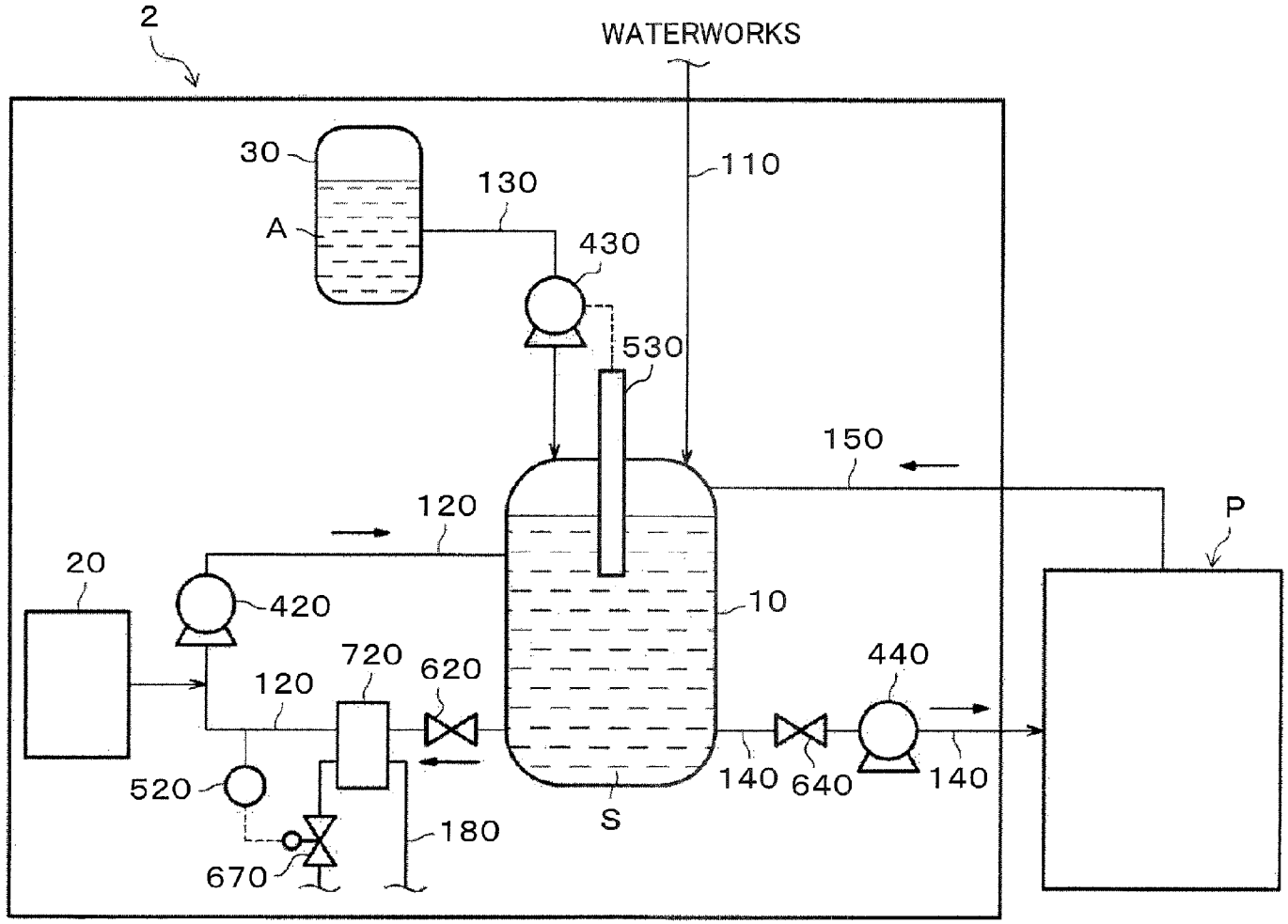
FIG. 4 is a block diagram of the cleaning system for piping according to a first variant.

FIG. 4 is a block diagram of the cleaning system for piping 2 according to a first variant.

The difference between the cleaning system 2 according to the first variant from the cleaning system 1 of the embodiment is that the cleaning system 1 is provided with a recirculation flow path 150 through which the cleaning water S passed through the piping is returned to be cleaned P to the reservoir 10 the cleaning water S has cleaned the piping to be cleaned P.

The cleaning system 2 is a system for returning the cleaning water S passed through the piping to be cleaned P to the reservoir 10, and reusing the cleaning water S for cleaning of the piping to be cleaned P.

The structure of the first variant will be described with reference to FIG. 4.

As the cleaning system 1, the cleaning system for piping 2 according to the first variant is mainly composed of a reservoir 10, an acid supply means 30, an ozone generation means 20, a circulating pump 420, and a conveying pump 440.

The water supply path 110, circulation flow path 120, acid supply path 130, and conduction flow path 140 form the flow paths, respectively, as in the cleaning system 1. A valve 620 is provided on the circulation flow path 120. A valve 640 is provided on the conduction flow path 140. An acid supply pump 430 is provided on an acid supply path 130.

As shown in FIG. 4, the cleaning system 2 may be provided with the temperature control means 720 and the temperature measuring means 520 in the circulation flow path 120.

The recirculation flow path 150 forms a flow path which communicates with an end portion at which the cleaning water S of the piping to be cleaned P is drained and the reservoir 10.

The recirculation flow path 150 is provided with a valve (not shown), which operates opening and closing of the flow path.

The recirculation flow path 150 may be provided with other means (not illustrated), for example, a temperature measuring means, a flow rate measuring means, an ozone concentration measuring means, a filter or the like.

Materials of piping and other components which form the recirculation flow path 150 are metals having resistance to the acid and ozone, with which the piping is brought into contact, for example, stainless steel. More specifically, it is SUS304, SUS316, and the like.

The passage sectional area of the recirculation flow path 150 is preferably similar to that of the conduction flow path 140.

Next, the operation of the cleaning system for piping 2 according to a first variant will be described.

As the cleaning system 1, the cleaning system 2 is connected to the piping to be cleaned P of the equipment to form the conduction flow path 140 which supplies he cleaning water S retained in the reservoir 10 in advance to the piping to be cleaned P.

In addition, the cleaning system 2 is connected to the waterworks to forma water supply path 110 which draws tap water used as raw water from the waterworks into the reservoir 10.

In addition, the solution-like acid A is retained in the acid supply means 30.

The cleaning system 2 is further connected to the piping to be cleaned P of the equipment to form the recirculation flow path 150 which returns the cleaning water S passed through the piping to be cleaned P to the reservoir 10.

The cleaning system 2 undergoes the same operation or process as the cleaning system 1, retains the cleaning water S which is passed through the piping to be cleaned P in the reservoir 10, and conveys the cleaning water S towards the piping to be cleaned P.

The cleaning water S which is conveyed to the piping to be cleaned P is passed through the piping to be cleaned from the upper stream end which is the connection position with the cleaning system 2 in the piping to be cleaned P to the downstream end which is a position where the piping structure ends of the piping to be cleaned P to clean the piping to be cleaned, and is then conveyed to the recirculation flow path 150 at the downstream end of the piping to be cleaned P.

The cleaning water S conveyed to the recirculation flow path 150 returns into the cleaning system 2 again, and is returned into the reservoir 10.

The cleaning water S which has been returned to the reservoir 10 then joins the cleaning water S which has been retained in the reservoir 10, and is mixed with ozone gas again as the circulating pump 420 and the ozone generation means 20 are operated. When an increase in the pH of the cleaning water S returned to the reservoir 10 is found at this time, the acid A may be supplied by operation of the acid supply means 30, and the pH may be readjusted.

As the conveying pump 440 is continuously operated, the cleaning water S in which ozone is mixed is conveyed towards the piping to be cleaned P from the cleaning system 2 via conduction flow path 140, and is passed through the piping to be cleaned P.

By repeating such a series of circulation between the cleaning system 2 and the piping to be cleaned P, the cleaning water S continuously cleans the piping to be cleaned P.

According to the first variant of the cleaning system for piping 2, the total amount of the cleaning water S required for cleaning can be reduced by reusing the cleaning water S, and the wastewater load involved in the cleaning processing is reduced.

In addition, a decrease in the ozone concentration of the cleaning water S is suppressed, and the cleaning effect is maintained in a predetermined range.

In addition, the energy consumption involved in the temperature control of the cleaning water S and mixing of ozone are suppressed.

Next, a second variant of the embodiment of the present invention will be described.

Figure 5:
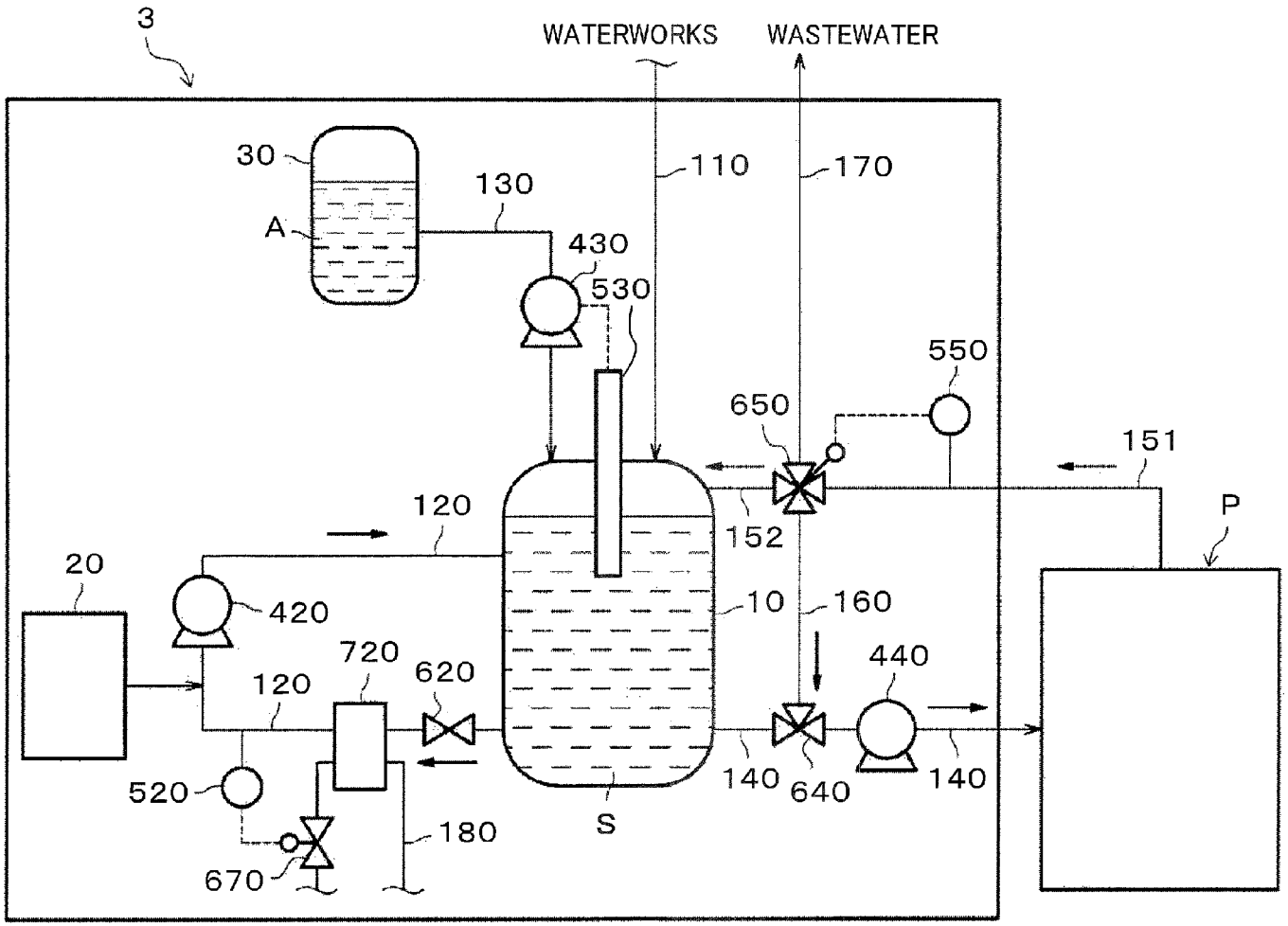
FIG. 5 is a block diagram of the cleaning system for piping according to a second variant

FIG. 5 is a block diagram of a cleaning system for piping 3 according to the second variant.

The difference between the cleaning system 3 according to the first variant from the cleaning system 1 of the embodiment is that the cleaning system 3 is provided with a recirculation flow path 150 through which the cleaning water S passed through the piping is returned to be cleaned P to the reservoir 10 the cleaning water S has cleaned the piping to be cleaned P, and a reflow flow path 160 through which the cleaning water S passed through the piping to be cleaned P is conveyed to the piping to be cleaned without being returned to the reservoir 10 after cleaning the piping to be cleaned P.

Furthermore, the cleaning system 3 according to the second variant is provided with a control valve 650 in the connection position of the recirculation flow path 150 and the conduction flow path 140. An ozone concentration measurement means 550 is provided on the recirculation flow path 151. The waste water control part 80 is connected to the control valve 650 and the ozone concentration measurement means 550 via a control line.

In addition, it is provided a drain passage 170 branched in the connection position of the recirculation flow path 150 and the conduction flow path 140.

The cleaning system 3 is provided with the controlling mechanism which selects the following two operation modes: a recirculation operation which returns the cleaning water S passed through the piping to be cleaned P to the reservoir 10, re-mixes ozone gas therein, and reuses the cleaning water S for cleaning the piping to be cleaned P; and water reflow operation mode which reuses the cleaning water S passed through the piping to be cleaned P for cleaning the piping to be cleaned P without returning the cleaning water S to the reservoir 10. The operation mode of waste water operation which drains the cleaning water S passed through the piping to be cleaned P can be also combined with this controlling mechanism.

As shown in FIG. 5, in the cleaning system 3, the recirculation flow path 150 is composed of the recirculation flow path 151 which connects the end of the piping to be cleaned P where the cleaning water S is drained to the control valve 650, and the recirculation flow path 152 which connects the control valve 650 and the reservoir 10 connected together.

The structure of a second variant will be described with reference to FIG. 5.

As the cleaning system 1, the cleaning system for piping 3 according to the second variant is mainly composed of a reservoir 10, an acid supply means 30, an ozone generation means 20, a circulating pump 420, and a conveying pump 440.

As in the cleaning system 1, the water supply path 110, circulation flow path 120, acid supply path 130, and conduction flow path 140 form flow paths, respectively; a valve 620 is provided on the circulation flow path 120; a valve 640 is provided on the conduction flow path 140; and an acid supply pump 430 is provided on the acid supply path 130. In FIG. 5, the valve 640 is composed of a cross valve.

In addition, as shown in FIG. 5, the circulation flow path 120 may be provided with a temperature control means 720 and a temperature measuring means 520.

The recirculation flow paths 151, 152 form the flow paths which communicate the end of the piping to be cleaned P where the cleaning water S is drained to the reservoir 10 as in the cleaning system 2.

The recirculation flow path 151 is provided with an ozone concentration measurement means 550 and a control valve 650.

A reflow flow path 160 is a flow path branching from the middle of the recirculation flow path 150, which forms a flow path for connecting the recirculation flow path 151 and the conduction flow path 140 by bypassing the reservoir 10.

In FIG. 5, the reflow flow path 160 is connected to the valve 640 which is a cross valve, and meets the conduction flow path 140.

In FIG. 5, the drain passage 170 is configured as a flow path branching in the connection position of the recirculation flow path 150 and the conduction flow path 140, and forms a flow path which connects the end of the piping to be cleaning P where the cleaning water S of the piping to be cleaned P is drained to a general waste water treatment facilities or the sewer located outside the cleaning system 3.

The recirculation flow paths 151, 152, reflow flow path 160, and drain passage 170 are formed of the closed structure in the piping or the cleaning system.

The recirculation flow paths 151, 152, reflow flow path 160, and drain passage 170 may be provided with other means (not shown), for example, a temperature measuring means, a flow rate measuring means or the like.

Materials of piping and other components which form the recirculation flow paths 151, 152, reflow flow path 160, and wastewater flow path 170 are metals having resistance to the acid and ozone, with which the piping is brought into contact, for example, stainless steel. More specifically, it is SUS304, SUS316, and the like.

The passage sectional areas of the recirculation flow paths 151, 152 and reflow flow path 160 are preferably similar to that of the conduction flow path 140. In addition, the passage sectional area of the drain passage 170 has preferably a size which is greater than the passage sectional area of the conduction flow path 140.

The control valve 650 is provided at a branching point of the recirculation flow path 150, reflow flow path 160, and drain passage 170. In FIG. 5, although the control valve 650 consists of a four-way valve, a two-way valve or the like may be arranged on the flow paths in place of the four-way valve as long as opening and closing of the flow paths are controlled. A solenoid controlled valve and a motor operated valve can be used as the control valve 650. As shown by the broken line in FIG. 5, the control valve 650 is connected to the pH measuring means 650 via a control line to switch flow paths by inputs of control signals.

The ozone concentration measurement means 550 is provided upstream of the control valve 650 in the direction of flow of the cleaning water.

A measuring instrument equipped with a glass electrode, ultraviolet absorption measuring instrument and the like are used as the ozone concentration measurement means 550.

As shown by the broken line in FIG. 5, the ozone concentration measurement means 550 is connected to the control valve 650 via a control line, and measures the ozone concentration of the cleaning water S passing through the recirculation flow path 151 to output measurement signals.

A waste water control part 80 which controls selection of a flow path based on the measured value of ozone concentration can be installed in the control line which connects the ozone concentration measurement means 550 to the control valve 650.

The waste water control part 80 can be provided with at least an operation part, a storage part, an input unit, and an output unit. The storage part is so configured to store a set value 1 and a set value 2 of the ozone concentration inputted from a user interface, and the operation part is so configured to be capable of calculating the ON/OFF, PID control and other operations with reference to the set values 1 and 2 based on the input of a measurement signal. In addition, the input unit receives measurement signals outputted by the ozone concentration measurement means 550, waste water operation directions, and the inputs of set values, and the output unit outputs control signals to the control valve 650.

For example, a value of the ozone concentration which performs switching to water recirculation operation and reflow operation is set as the set value 1, while the value of the ozone concentration which performs switching to the waste water operation, recirculation operation, or reflow operation is set as the set value 2.

Drain operation demands include a direction of drainage from the user made via user interface, and a demand from the system at the end of water passage cleaning.

Next, the operation of the cleaning system for piping 3 according to a second variant will be described.

As the cleaning system 1, the cleaning system 3 is connected to the piping to be cleaned P of the equipment to form the conduction flow path 140 which supplies the cleaning water S retained in the reservoir 10 in advance to the piping to be cleaned P.

In addition, the cleaning system 2 is connected to the waterworks to form a water supply path 110 which draws tap water used as raw water from the waterworks into the reservoir 10.

In addition, the solution-like acid A is retained in the acid supply means 30.

The cleaning system 3 is further connected to the piping to be cleaned P of the equipment to form the recirculation flow path 150 which returns the cleaning water S passed through the piping to be cleaned P to the reservoir 10.

When control is carried out by combining the drainage operation mode is, the cleaning system 3 is connected to a general waste water treatment facilities or the sewer to form a drain passage 170 which drains the cleaning water S passed through the piping to be cleaned P to the outside of the cleaning system 3.

The cleaning system 3 can employ three types of operation modes: recirculation operation, reflow operation, and drainage operation, each having a different mode of circulation of the cleaning water S.

The cleaning system 3 undergoes the same operation or process as the cleaning system 1, retains the cleaning water S which is passed through the piping to be cleaned P in the reservoir 10, and conveys the cleaning water S towards the piping to be cleaned P.

The cleaning water S which is conveyed to the piping to be cleaned P is passed through the piping to be cleaned from the upper stream end which is the connection position with the cleaning system 3 in the piping to be cleaned P to the downstream end which is a position where the piping structure ends of the piping to be cleaned P to clean the piping to be cleaned, and is then conveyed to the recirculation flow path 151 at the downstream end of the piping to be cleaned P.

At this time, the ozone concentration of the cleaning water S passing through the recirculation flow path 151 is measured by the ozone concentration measurement means 550, and the measured value is outputted as a measurement signal to the waste water control part 80.

The wastewater control unit 80, when it receives an input of a measurement signal, performs a control to select of the operation mode based on the measurement value range, and outputs a control signal of either the recirculation control for performing the recirculation operation, the reflow control for performing the reflow operation, or the waste water control for performing the waste water operation to the control valve 650. The control method is not particularly limited. An example is a method of setting a concentration value which is determined to be such a value that an required amount of ozone is dissolved to a degree that remixing of ozone is not required to a set value 1, and setting a concentration value which is determined to be such a value that the ozone concentration is extremely lowered to a set value 2, and causing the operation mode to correspond to measurement ranges having the set values as boundaries.

In this case, the waste water control part 80 first determines the existence of a waste water operation demand.

When a waste water operation demand is confirmed, the waste water control part 80 outputs a control signal of the waste water control.

When a waste water operation demand is not confirmed, the waste water control part 80 compares the measured value from the ozone concentration measurement means 550 and the set value 2, and if the measured value is lower than the set value 2, the control signal of the waste water control is outputted. Furthermore, when the measured value is not lower than the set value 2, the measured value from the ozone concentration measurement means 550 and the set value 1 are compared, and if the measured value is equal to or higher than the set value 1, a control signal of the reflow control is outputted, and while if the measured value is lower than the set value 1, a control signal of the recirculation control is outputted.

The recirculation operation is the operation mode in which the cleaning water S passed through the piping to be cleaned P from the reservoir 10 cleans the piping to be cleaned P, and is then returned to the reservoir 10, and the cleaning water S circulates in the same flow path as in the cleaning system 2.

The recirculation operation is selected when the ozone concentration of the cleaning water S is lower than the set value 1, and consumption of ozone by water passage is found.

When the waste water control part 80 accepts a measured value which is lower than one the set value 1, it outputs to the control valve 650 a control signal of the recirculation control for opening the recirculation flow path 152, closing the reflow flow path 160, and closing the drain passage 170.

The control valve 650 which has received the input of the signal operates release and closing of the flow path, and forms a flow path in which the recirculation flow path 151 is connected only to the recirculation flow path 152.

Thereafter, the cleaning water S conveyed from the downstream end of the piping to be cleaned P to the recirculation flow path 151 is returned to the reservoir 10 via recirculation flow path 152.

The cleaning water S returned to the reservoir 10 joins the cleaning water S retained in the reservoir 10, and is re-mixed with ozone gas as the circulating pump 420 and the ozone generation means 20 operate. When an increase in the pH of the cleaning water S returned to the reservoir 10 is found at this time, the acid A may be supplied by operation of the acid supply means 30 so that the pH is readjusted.

As the conveying pump 440 is continuously operated, the cleaning water S in which the ozone is mixed is conveyed towards the piping to be cleaned P from the cleaning system 2 via conduction flow path 140, and is passed through the piping to be cleaned P.

According to the operation mode of such recirculation operation, the same effects as in the cleaning system 2 are obtained.

The reflow operation is an operation mode in which the cleaning water S passed through the piping to be cleaned P from the reservoir 10 cleans the piping to be cleaned P, and then is reused for cleaning the piping to be cleaned P without being returned to the reservoir 10.

The reflow operation is selected when the ozone concentration of the cleaning water S is higher than the set value 1, and consumption of ozone by water passage is not found.

When the waste water control part 80 accepts a measured value which is equal to or higher than the set value 1, it outputs to the control valve 650 a control signal of the recirculation control for closing the recirculation flow path 152, opening the reflow flow path 160, and closing the drain passage 170.

The control valve 650 which has received the input of the sign operates release and closing of the flow path, and forms a flow path in which the recirculation flow path 151 is connected only to the reflow flow path 160.

At this time, directional control of the flow path in the valve 640 may be also performed so that the flow path to which water is conveyed from the reservoir 10 is closed.

Thereafter, the cleaning water S conveyed from the downstream end of the piping to be cleaned P to the recirculation flow path 151 is conveyed towards the piping to be cleaned P from the cleaning system 3 via the reflow flow path 160 as the conveying pump 440 is continuously operated, and is passed through the piping to be cleaned P.

According to such an operation mode of the reflow operation, the total amount of the cleaning water S required for cleaning can be reduced by reusing the cleaning water S, and the wastewater load involved in the cleaning processing is reduced.

Moreover, temperature adjustment and ozone mixing can be paused during the reflow operation, and the energy consumption involved in the temperature control of the cleaning water S and mixing of ozone are suppressed.

The drainage operation is an operation mode in which the cleaning water S passed through the piping to be cleaned P from the reservoir 10 cleans the piping to be cleaned P, and is then discharged to the outside of the cleaning system.

The drainage operation is selected when the ozone concentration of the cleaning water S is lower than the set value 2, or there is a drainage operation demand.

When the waste water control part 80 accepts a measured value which is lower than the set value 2 or a drainage operation demand, it outputs to the control valve 650 a control signal of the drainage control for closing the recirculation flow path 152, closing the reflow flow path 160, and closing the drain passage 170.

The control valve 650 which has received the input of the signal operates release and closing of the flow path, and forms a flow path in which the recirculation flow path 151 is connected only to the drain passage 170.

Thereafter, the cleaning water S conveyed to the recirculation flow path 151 from the downstream end of the piping to be cleaned P is discharged to the outside of the cleaning system via the wastewater flow path 170, and conveyed to a general wastewater process facility or the sewage to be wasted.

According to such an operation mode of the drainage operation, the management of the flow rate of the cleaning water S circulating between the cleaning system 3 and piping to be cleaned P is facilitated.

In addition, contaminants which have entered into the cleaning water S after being passed through the piping to be cleaned can be eliminated from the cleaning water S which circulates through the piping to be cleaned P.

The invention claimed is:

1. A system for cleaning inside piping by conveying cleaning water through the piping to be cleaned, the system comprising:

a reservoir for retaining the cleaning water;

an acid providing device which supplies an acid to the cleaning water;

an ozone generation device which generates ozone gas;

a circulation flow path including a circulation pump which connects the reservoir and the ozone generation device in the form of a closed circuit, and circulates the cleaning water between the reservoir and ozone generation device;

a conduction flow path comprising a conveying pump which communicates the reservoir and the piping to be cleaned, and conveys the cleaning water retained in the reservoir through the piping to be cleaned;

a return flow path which connects an end of the piping to be cleaned from which conveyed wastewater of the cleaning water is discharged to the reservoir;

a reflow flow path which connects the recirculation flow path and the conduction flow path by bypassing the reservoir;

an ozone concentration measuring device provided on the recirculation flow path, the ozone concentration measuring device measuring the ozone concentration of the cleaning water in the recirculation flow path; and a control valve provided in a connection position of the recirculation flow path and the reflow flow path, wherein the cleaning system circulates the cleaning water containing the acid through the circulation flow path, mixes the ozone gas into the cleaning water, and passes the cleaning water through the piping to be cleaned via the conduction flow path, and wherein when the ozone concentration is equal to or higher than a predetermined value, the control valve opens a flow path from the recirculation flow path to the reflow flow path and closes a flow path from the recirculation flow path to the reservoir.

2. The cleaning system for piping according to claim 1, wherein the system further includes a temperature control device provided on the circulation flow path or the reservoir.

* * * * *